US007384242B2

(12) United States Patent
Ming

(10) Patent No.: US 7,384,242 B2
(45) Date of Patent: Jun. 10, 2008

(54) IMPELLER BLADE AND FAN

(76) Inventor: Chen Shih Ming, No. 26 Meifong St., North District, Taichung City 404, TW (CN)

( * ) Notice: Subject to any disclaimer, the term of this patent is extended or adjusted under 35 U.S.C. 154(b) by 440 days.

(21) Appl. No.: 11/155,952

(22) Filed: Jun. 17, 2005

(65) Prior Publication Data

US 2006/0285977 A1 Dec. 21, 2006

(51) Int. Cl.
*F04D 29/38* (2006.01)

(52) U.S. Cl. ..... 416/210 R; 416/235; 416/243

(58) Field of Classification Search ..... 416/243, 416/235, 236 R, 238, 210 R
See application file for complete search history.

(56) References Cited

U.S. PATENT DOCUMENTS 3,659,959 A * 5/1972 Holstrom ..... 416/223 R
5,542,819 A * 8/1996 Bucher et al. ..... 416/210 R

* cited by examiner

*Primary Examiner*—Richard Edgar

(57) ABSTRACT

An impeller blade includes an elongate impeller blade body having opposing proximal and distal ends, opposing first and second edges extending from the proximal end to the distal end, and opposing upper and lower sides. The lower side includes a major generally concave channel extending from an open end thereof at the distal end of the impeller blade body to a closed end thereof adjacent to the proximal end of the impeller blade body.

3 Claims, 16 Drawing Sheets

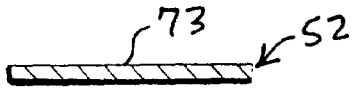
FIG. 7
FIG. 6
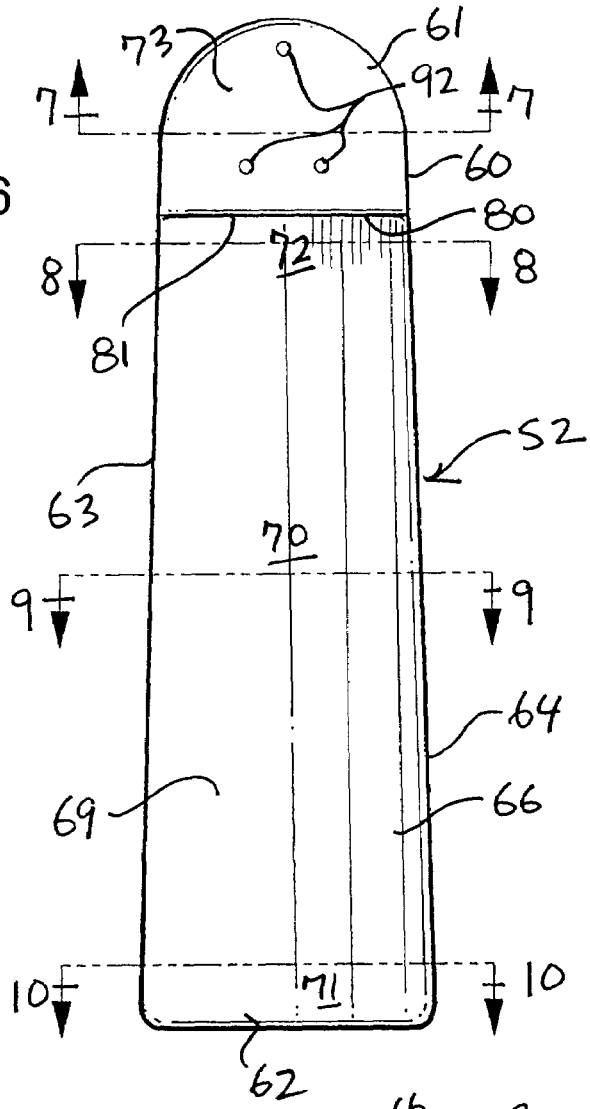
FIG. 8
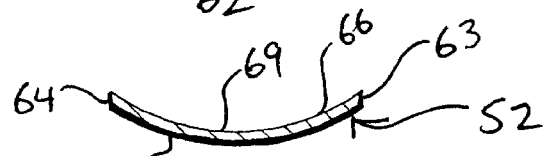
FIG. 9
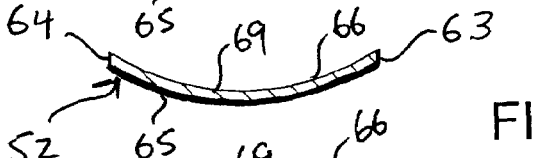
FIG. 10
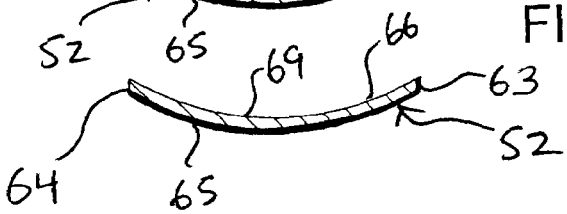

73
110

73
110
61
60
73
35
35
36
36
111
112
72
37
37

110
38
38
70
69
63
64
66
39
39
71
62

64
69
66
63
110
65

64
69
66
63
110
65

69
66
63
110
64
65

IMPELLER BLADE AND FAN

FIELD OF THE INVENTION

The present invention relates to fans and to fan blades.

BACKGROUND OF THE INVENTION

Ceiling fans are as much a part of interior decor as furniture, household accessories and artwork. Often the design of a ceiling fan is carefully chosen to match or enhance a selected interior decor. Due to the importance that is now placed on new and innovative ceiling fan designs, and because ceiling fan design is considered by many to be an integral component of the fashion of interior and exterior living spaces, tremendous effort has been directed toward the design of ceiling fans, and particularly the design of the components of ceiling fans, including fan housing, fan blades, fan blade brackets, and ceiling fan light fixtures. As a result of this focus on design, comparatively little effort has been directed of late toward improving the structure and function of ceiling fans and to improving the air displacement characteristics of ceiling fans, which thus necessitates the continuing and ongoing improvement in the art.

SUMMARY OF THE INVENTION

An impeller blade consists of an elongate impeller blade body including opposing proximal and distal ends, opposing first and second edges extending from the proximal end to the distal end, and opposing upper and lower sides. The lower side includes a major generally concave channel extending from an open end thereof at the distal end of the impeller blade body to a closed end thereof adjacent to the proximal end of the impeller blade body. The lower side is formed with a bracket receiving face disposed between the closed end and the proximal end. An end wall formed in the lower side of the impeller blade body defines the closed end of the generally concave channel. The end wall resides in an end wall plane, and the bracket receiving face resides in a receiving face plane, in which the end wall plane is different from the receiving face plane. In a particular embodiment, the end wall plane is substantially perpendicular relative to the receiving face plane. Preferably, the bracket receiving face is generally planar. A generally concave surface is formed in the lower side of the impeller blade body forming the generally concave channel. The impeller blade body defines a longitudinal axis extending from the proximal end to the distal end, and the bracket receiving face extends from the proximal end of the impeller blade body to a first edge formed in the lower side and which is transverse relative to the longitudinal axis of the impeller blade body. The end wall projects toward the generally concave surface from the first edge and terminates at the generally concave surface with a second edge which is transverse relative to the longitudinal axis of the impeller blade body. The invention also provides an impeller incorporating fan blades each constructed and arranged in accordance with the invention.

Consistent with the foregoing summary of the invention and the ensuing specification, which are to be taken together, the invention also contemplates associated impeller, fan, and impeller blade embodiments.

BRIEF DESCRIPTION OF THE DRAWINGS

Referring to the drawings:

FIG. 6 is a bottom plan view of the impeller blade of FIG. 2;

FIG. 7 is a sectional view taken along line 7-7 of FIG. 6;

FIG. 8 is a sectional view taken along line 8-8 of FIG. 6;

FIG. 9 is a sectional view taken along line 9-9 of FIG. 6;

FIG. 10 is a sectional view taken along line 10-10 of FIG. 6;

DETAILED DESCRIPTION OF PREFERRED EMBODIMENTS

Figure 1:
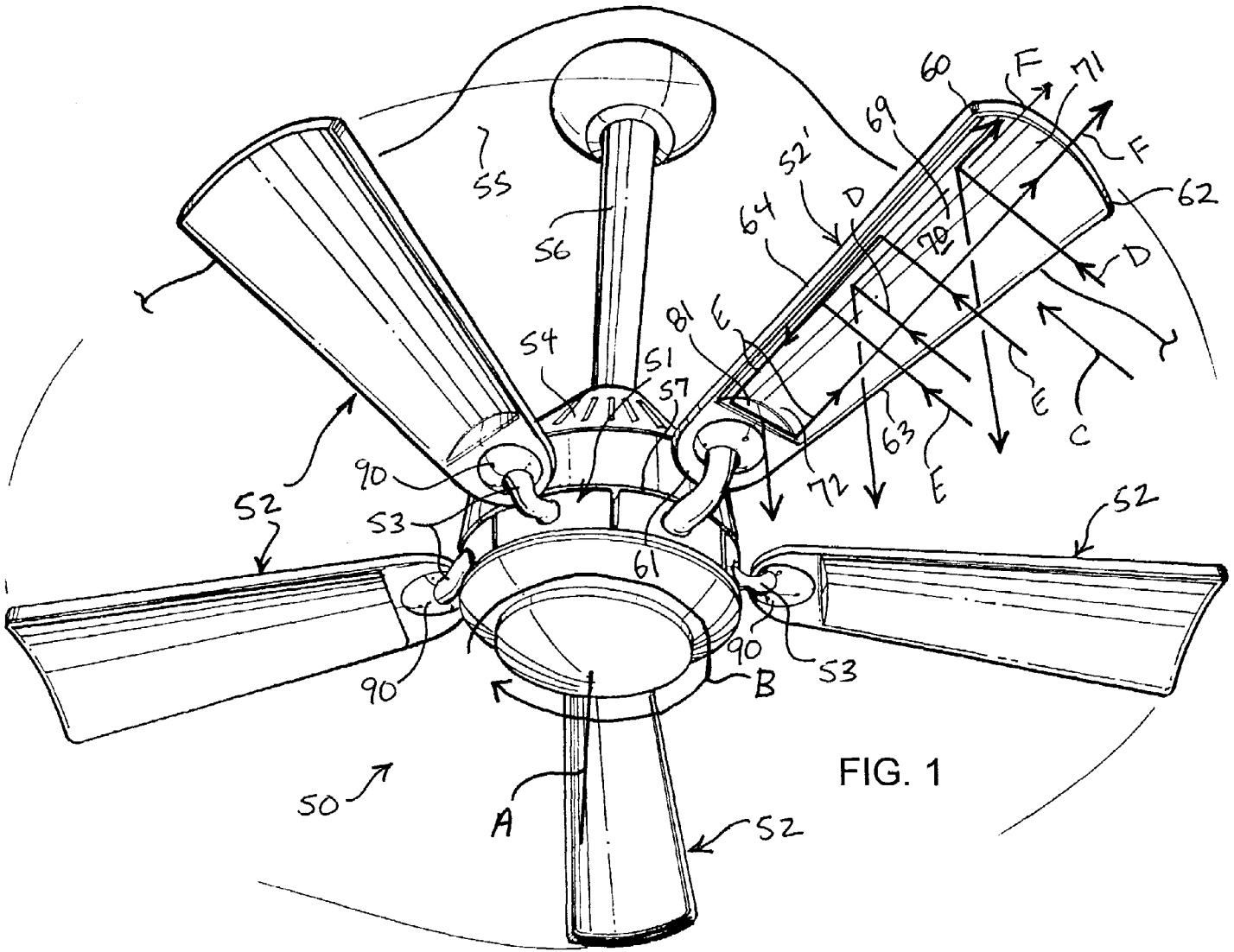
FIG. 1 is a perspective view of an impeller incorporating impeller blades each constructed and arranged in accordance with the principle of the invention.

Turning now to the drawings, in which like reference characters indicate corresponding elements throughout the several views, attention is first directed to FIG. 1 in which there is seen a bottom perspective view of a fan 50 including an impeller 51 constructed and arranged in accordance with the invention. The invention is useful with all types of fans, and is particularly useful in connection with ceiling fans and other like fans particular suited to displace air. In this particular embodiment, fan 50 is a ceiling fan and impeller 51 is shown as it would appear partially held within a decorative housing 54 and suspended by and mounted to a shaft 56 for rotation along an axis A from a ceiling 55. Impeller 51 is comprised of a hub 57 having a plurality of attached impeller/fan blades 52 each for displacing air. Blade holders or brackets 53 attach impeller blades 52 to hub 57 and screws, rivets or other suitable engagement apparatus connect blades 52 to brackets 53 and brackets 53 to hub 57. Although fan 50 is shown as it would appear mounted to a ceiling with a shaft or down rod, those having regard for the art will readily appreciate that fan 50 can be mounted in place to a ceiling in other ways in accordance with traditional ceiling fan mounting techniques. Some ceiling fans are actually mounted outdoors on elongate supports, and a ceiling fan constructed and arranged in accordance with the invention may certainly be suspended at an elevated location in this way, if desired.

The impeller 51 hub 57 is rotated by a conventional electric motor, which is enclose in housing 54 and is not shown. The motor is operable for driving impeller 51 for rotation and is contained within a chamber bound by housing 54. The motor and the housing encircle a central shaft in housing 54 and are substantially axially aligned along axis A of rotation of impeller 51. The motor is fixed to the central shaft and bearings couple impeller 51 to the central shaft and allow it to rotate freely relative to the central shaft and this is a conventional arrangement that is common to ceiling fans. When the motor is energized with electrical power, it causes impeller 51 and its attached impeller blades 52 to rotate and this is also a conventional arrangement. What is not conventional, however, is the geometry and structure of impeller blades 52 and, of course, the resulting impeller and fan incorporating impeller blades 52. In this regard, impeller blades 52 are constructed and arranged in accordance with the principle of the invention and are identical to one another. Accordingly, the structural and functional details of only one of impeller blades 52 will now be discussed with the understanding that the ensuing discussion applies to each of impeller blades 52.

Figure 2:
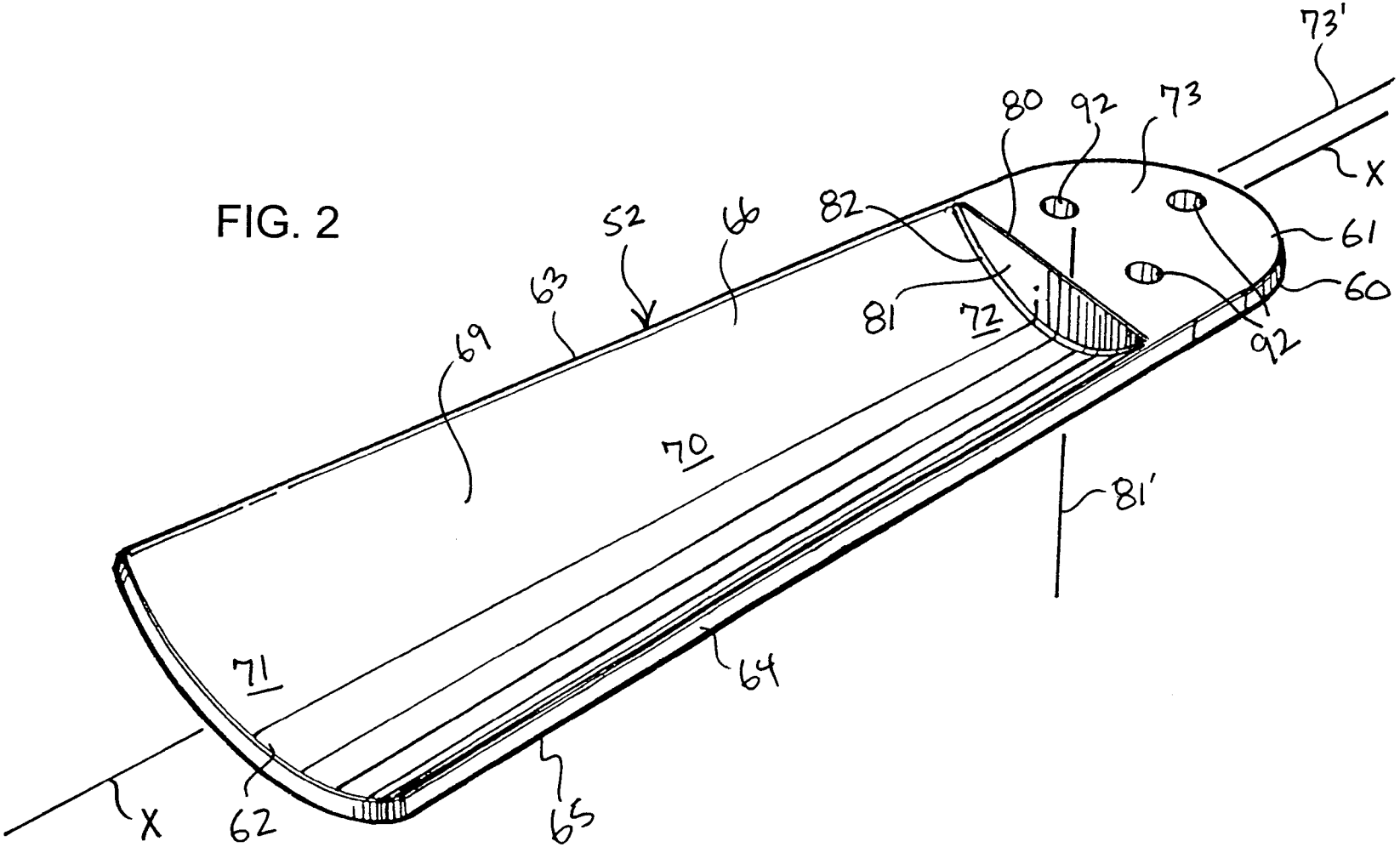
FIG. 2 is a bottom perspective view of one of the impeller blades of FIG. 1 shown as it would appear detached from the ceiling impeller.
Figure 4:
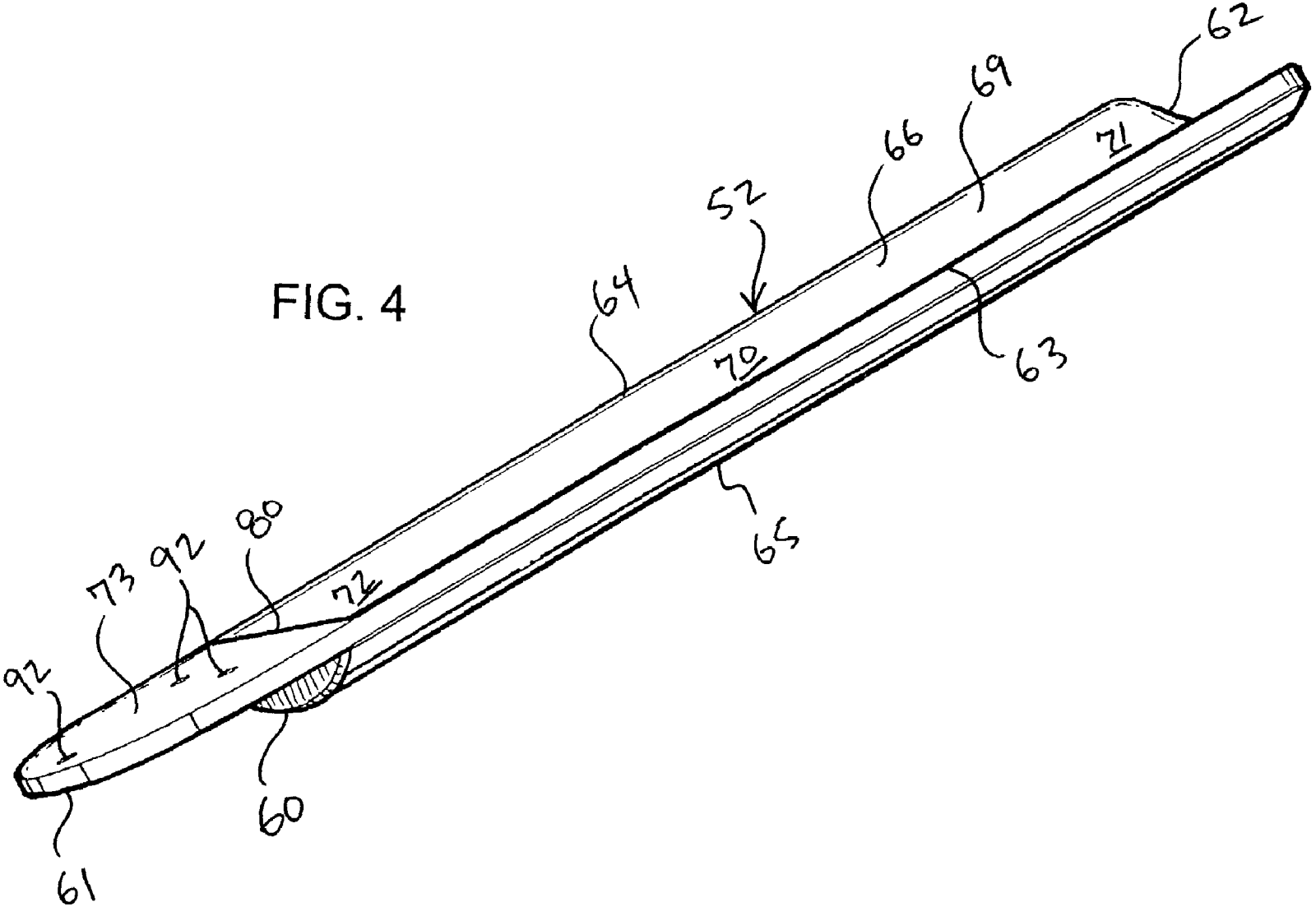
FIG. 4 is a bottom perspective view of the impeller blade of FIG. 2.
Figure 5:
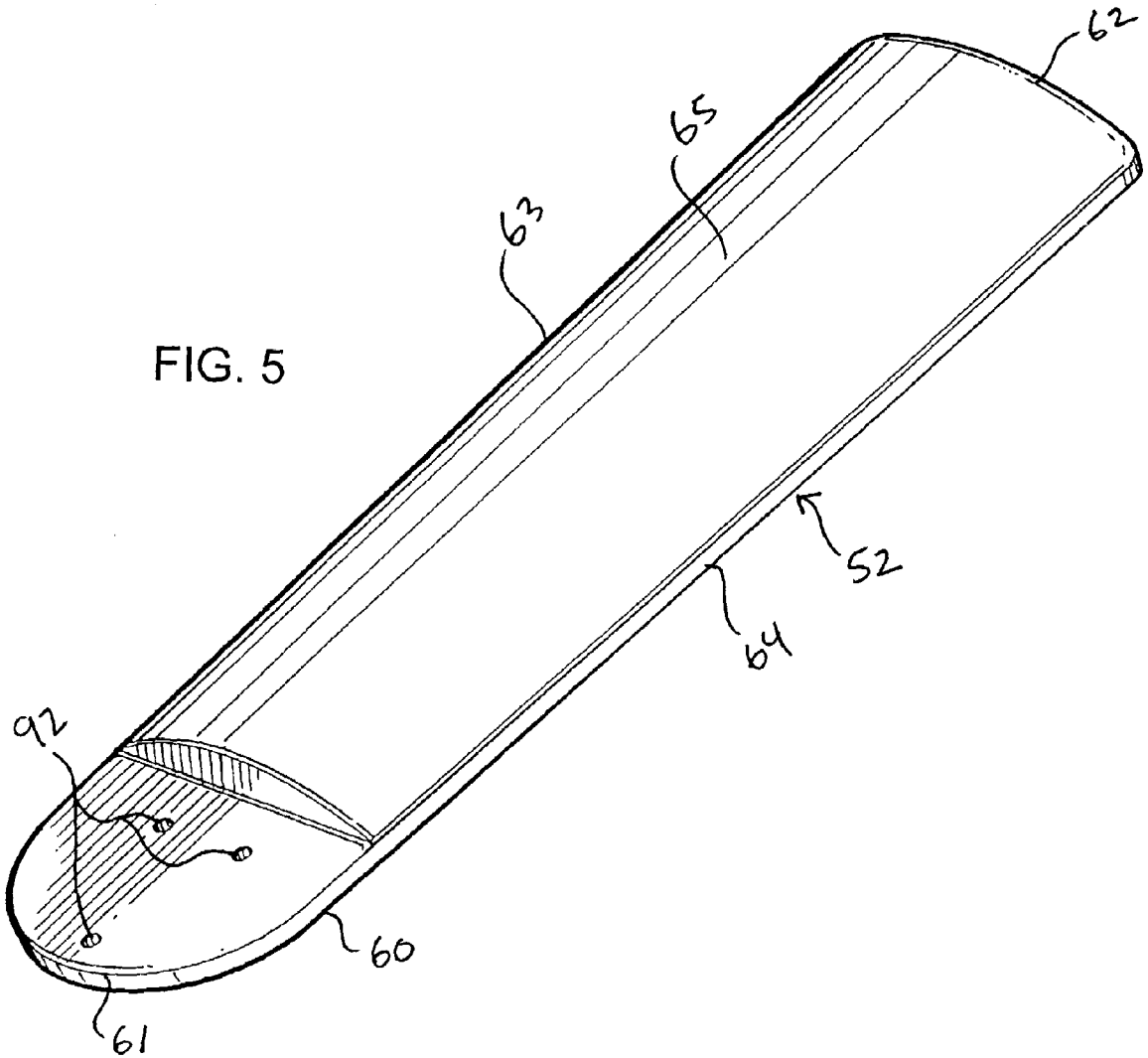
FIG. 5 is a top plan view of the impeller blade of FIG. 2.

Referring now to FIGS. 2, 4, and 5, impeller blade 52 consists of an impeller blade body 60, which is formed from plastic, wood, metal, or other substantially rigid material or combination of materials. Body 60 is preferably integrally formed, but it can be fashioned of a plurality of attached parts, if desired. According to the principle of the invention, body 60 includes opposing proximal and distal ends 61 and 62, opposing edges 63 and 64 extending from proximal end 61 to distal end 62, and opposing upper and lower sides 65 and 66. Looking specifically to FIG. 2, lower side 66 is the lower air-displacing side of blade 52, and is characterized by a major generally concave major surface 69 defining a major generally concave channel 70 extending longitudinally relative to body 60 along substantially the entire length of body 60 from an open end 71 thereof at distal end 62 of body 60 to a closed end 72 thereof adjacent to proximal end 61 of body 60. In this embodiment, channel 70, which is defined by concave surface 69, extends laterally of body 60 from edge 63 to edge 64 as illustrated.

Lower side 66 is formed with an impeller blade bracket receiving/attachment face/surface 73, which is disposed between closed end 72 and proximal end 61. Receiving face 73 is substantially planar and extends from proximal end 61 to an edge 80, which is transverse relative to a longitudinal axis X (FIG. 2) of body 60 from proximal end 61 to distal end 62 and which extends laterally of body 60 from edge 63 to edge 64. An end wall 81 projects toward concave surface 69 from edge 80 and terminates at concave surface 69 with a concave edge 82 that, like edge 80, is transverse relative to the longitudinal axis of body 60 and which extends laterally of body 60 from edge 63 to edge 64 and that actually meets edge 80 at edges 63 and 64, respectively, of body 60. Concave surface 69 and end wall 81 meet at concave edge 82. End wall 81 faces into channel 70 and forms closed end 72, in accordance with the principle of the invention. As seen in FIG. 2, end wall 81 resides in a an y-z end wall plane designated generally at 81', and receiving face 73 resides in an x-y receiving face plane designated generally at 73', in which end wall plane 81' is substantially perpendicular relative to receiving face plane 73' and also to the longitudinal axis of body 60.

Figure 3:
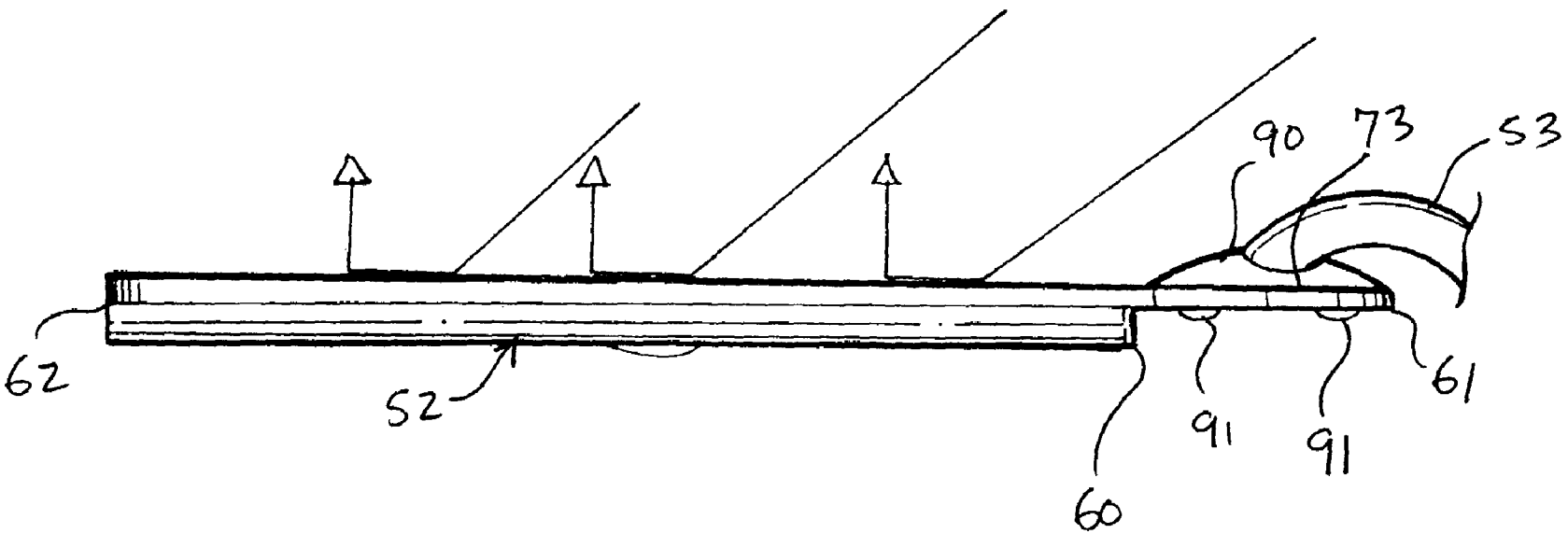
FIG. 3 is an inverted right side elevational view of one of the impeller blades of FIG. 1 including a fragmented view of an impeller blade bracket secured to an attachment end of the impeller blade.

Looking back to FIG. 1, impeller 51 incorporates five attached impeller blades 52, in which the lower sides 66 thereof face downwardly away from ceiling 55. When impeller 51 rotates, the lower sides 66 of impeller blades 52, which are the air-displacing sides of impeller blades 52, displace air and provide the desired downward air movement. In this embodiment, five impeller blades 52 are attached to hub 57 forming a five-bladed impeller, and this is disclosed as a matter of example with the understanding that less or more impeller blades 52 may be used depending on specific needs. Also, impeller blades 52 are attached to hub 57 with brackets 53, and FIG. 3 shows one impeller blade 52 as it would appear attached to one bracket 53. As seen in FIG. 3, bracket 53 has a blade attachment end 90, which is presented against receiving face 73 and secured thereto with threaded fasteners 91, which are passed into and through access openings 92 (FIG. 2) through proximal end 61 of body 60 from upper side 65 of body 60 to lower side 66 of body 60 and are from there threadably received into corresponding threaded openings (not shown) formed in attachment end 90 of bracket 53. In this specific embodiment, three screws 91 are used to secure attachment end 90 to receiving face 73 of impeller blade 52, although it is to be understood that less or more may be used depending on specific needs. Screws 91 are disclosed as a preferred way of securing attachment end 90 to receiving face 73 of impeller blade 52 insofar as threaded fasteners are typically used for securing impeller blades to impeller/fan blade brackets and are inexpensive. As previously mentioned, impeller blades 52 can be attached to brackets in other ways, such as with rivets, engagement assemblies, nut-and-bolt assemblies, etc. Furthermore, although brackets 53 are used to secure impeller blades 52 to hub 57 forming impeller 51, impeller blades 52 can be attached to hub 57 in other ways commensurate with the knowledge and skill attributed to the skilled artisan, such as, for example, with engagement slots formed into hub 57 or the like.

When fan 50 is activated, impeller 51 rotates and blades 52 move through and displace air. As a matter of reference, it is to be understood that impeller 52 rotates in a clockwise direction about axis A of rotation when looking up at the lower sides of blades 52 as indicated by the circular arrowed line B, and the discussion of the blades 53 displacement of air will be discussed in conjunction with just such a rotation of impeller 51 in which case edges 63 are considered leading edges of blades 52 and edges 64 are considered trailing edges of blades 52. Although the ensuing discussion is to be considered in light of impeller rotating in a clockwise direction when looking up at the lower side of blades 52, the invention works equally well in the counterclockwise direction of rotation.

Figure 12:
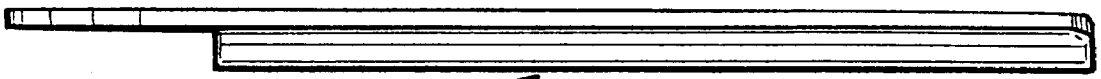
FIG. 12 is a right side elevational view of the impeller blade of FIG. 2.
Figure 13:
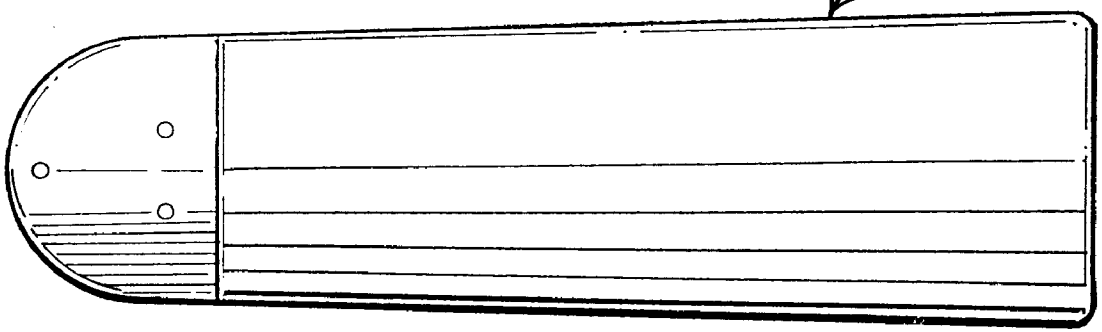
FIG. 13 is an unobstructed bottom plan view of the impeller blade of FIG. 2.
Figure 11:
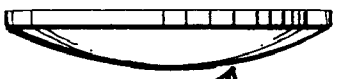
FIG. 11 is a rear elevational view of the impeller blade of FIG. 2.
Figure 15:
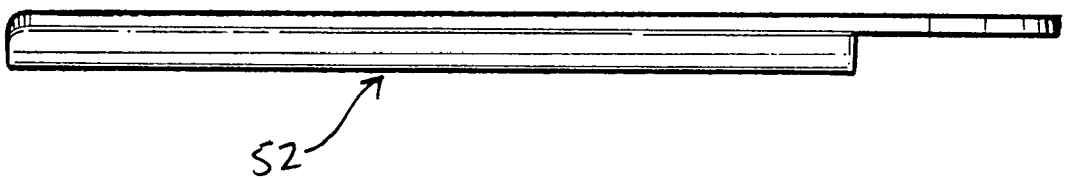
FIG. 15 is a left side elevational view of the impeller blade of FIG. 2.
Figure 16:
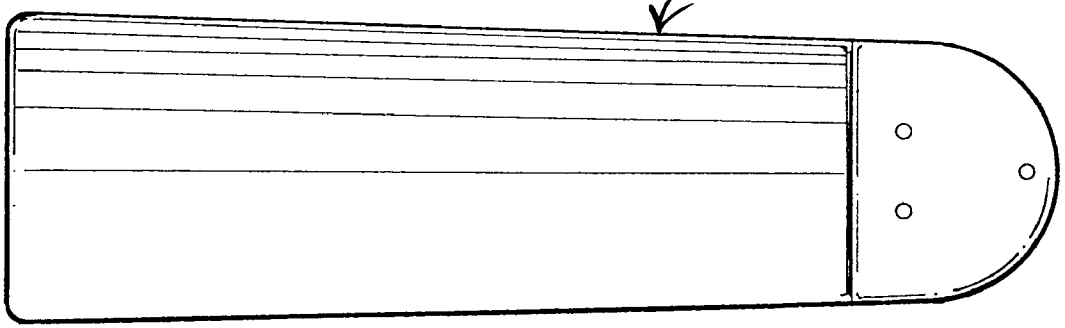
FIG. 16 is a top plan view of the impeller blade of FIG. 2.
Figure 14:
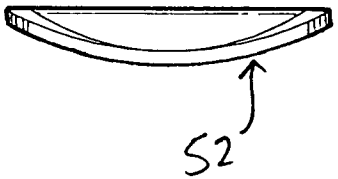
FIG. 14 is a front elevational view of the impeller blade of FIG. 2.

FIGS. 4-16 show various views of impeller blade 52 and denote relevant reference numerals denoting the various structural features thereof. As a matter of disclosure, FIG. 4 is a bottom perspective view of blade 52, FIG. 5 is a top plan view of blade 52, and FIG. 6 is a bottom plan view of blade 52. The vertical sectional profiles of blade 52 are shown in FIGS. 7-10, in which FIG. 7 is a sectional view taken along line 7-7 of FIG. 6, FIG. 8 is a sectional view taken along line 8-8 of FIG. 6, FIG. 9 is a sectional view taken along line 9-9 of FIG. 6, and FIG. 10 is a sectional view taken along line 10-10 of FIG. 6. As see in FIG. 6 and also FIGS. 8-10, channel 70 widens gradually from closed end 72 to open end 71. Still further, FIG. 11 is a rear elevational view of blade 52, FIG. 12 is a right side elevational view of blade 52, FIG. 13 is an unobstructed bottom plan view of blade 52, FIG. 14 is a front elevational view of blade 52, FIG. 15 is a left side elevational view of blade 52, and FIG. 16 is a top plan view of blade 52.

With continuing reference to FIG. 1, it is to be understood that blades 52 are mounted in such a way that their lower sides 66 are at least partially directed into the direction of travel and into oncoming air. This places the lower sides of blades 52 into an open angle of attack relative to the direction of rotational travel of impeller 51 so that when impeller 51 rotates the lower sides 66 of blades 52 will be at least partially directed into the oncoming air allowing the lower sides 66 to attack and displace air. In this regard, it is to be understood that air passes over blades 52 from the leading edges 63 to their trailing edges 64, and the manner of how blades 52 function to displace air will now be discussed with reference to the impeller blade denoted at 52' in FIG. 1, in which the ensuing discussion of the air displacing characteristics of impeller blade 52' applies to all impeller blades 52.

As seen in FIG. 1, air travels across blade 52' from its leading edge 63 to its trailing edge 64 as generally indicated by arrowed line C. Because blade 52' is disposed in an open angle of attack as previously explained, its concave surface 69 is at least partially directed into the oncoming air. Therefore, as blade 52' rotates air travels over leading edge 63 and into and is captured by channel 70 and is deflected therefrom forming directed flows of deflected/displaced air.

In particular, air traveling into channel 70 from leading edge 63 is captured in channel 70 and deflected downwardly by concave surface 69 adjacent trailing edge 64 as generally represented by the angled arrowed lines D. As referenced by arrowed circulation lines E, air traveling into and captured by channel 70 from leading edge 63 also deflects inwardly from concave surface 69 adjacent trailing edge 64 as generally indicated by the angled arrowed line E toward closed end 72. When this deflected air reaches closed end 72, it is trapped there and deflected by end wall 81 and also concave surface 69 adjacent end wall 81 and trailing edge 64, in which some of the air is and circulated back into and through channel 70 and directed outwardly through open end 71 of channel 70 producing a focused stream of air outwardly through open end 71 of channel 70, and in which some of the air is directed downwardly away from concave face 69 from end wall 81, in accordance with the principle of the invention. Still further, air traveling into channel 70 from leading edge 63 is captured in channel 70 and can also be deflected outwardly by concave surface 69 through open end 70 of channel in the form of a focused steam of air. And so air passing into channel 70 is deflected downwardly away from concave surface 69, circulated in channel 70 forming a high pressure turbulated flow of air in channel 70 which is forcibly directed not only downwardly away concave surface 69 but also forcibly outward through open end 71 of channel 70, and is also deflected outwardly through open end 71 of channel 70. The provision of concave surface 69 and end wall 81 forming channel 70 having open end 71 at distal end 62 of body 60 and closed end 72 at proximal end 61 of body 60 therefore produces an aggressive and widespread displacement of air heretofore not available with conventional impeller blades in the form of the aggressive downwardly displacement of air from concave surface 69 along the entire length of channel 70 from close end 72 to open end 71 and an the aggressive lateral displacement of air outwardly from open end 71 of channel 70, in accordance with the principle of the invention. Having an impeller incorporating impeller blades 52 constructed and arranged in accordance with the principle of the invention as with impeller 51 shown in FIG. 1 produces an impeller which is capable of producing a surprisingly aggressive and widespread displacement of air. Due to the aggressive air-displacement characteristics of blades 52, the rotation of an impeller incorporating blades 52 need not be at conventionally high speeds in order to produce a suitable level of air displacement, which saves electrical energy and prevents a fan incorporating blades 52 from falling out of balance.

As previously explained, impeller 51 incorporates five impeller blades 52 in FIG. 1. Again, this is shown merely as a matter of example and it is to be understood that impeller 51 can incorporate less or more impeller blades 52 depending on required needs. Not only may an impeller incorporate any desired number of impeller blades 52 constructed and arranged in accordance with the principle of the invention, the size of blades 52 can also be varied if desired for increasing or decreasing the amount of displaced air.

Turning now to FIG. 17-29 there is seen an alternate embodiment of an impeller blade 100 constructed and arranged in accordance with the principle of the invention. In common with impeller blade 52 set forth in conjunction with FIGS. 1-16, impeller blade 100 shares impeller blade body 60, proximal and distal ends 61 and 62, opposing edges 63 and 64, opposing upper and lower sides 65 and 66, concave major surface 69, concave channel 70 including open end 71 and closed end 72, impeller blade bracket receiving face/surface 73, edge 80, end wall 81, concave edge 82, and receiving face plane designated generally at B. Unlike impeller blade 52, end wall 81 is angled forwardly of edge 80 residing in end wall plane 81' forming a less than 90 degree angle Ø between end wall plane 81' and receiving face plane 73' inboard of edge 80 facing proximal end 61, and a greater than 90 degree angle β between end wall plane 81' and receiving face plane 73' outboard of edge 80 facing distal end 62. The purpose of impeller blade embodiment designated at 100 is to show that end wall 81 need not be substantially perpendicular relative receiving face plane 73' and also to the longitudinal axis of body 60. Other than this one difference, the remaining structural and functional characteristics of impeller blade 100 are identical to that of impeller blade 52, and so the foregoing discussion of impeller blade 52 also applies to impeller blade 100. However, because end wall 81 in embodiment designated 100 is angled forwardly toward open end 71 of channel, it does function to displace air hitting it away from lower side 66. Other than this small difference, impeller blade 100 functions identically to impeller blade 52 and is completely analogous to impeller blade 52.

Figure 17:
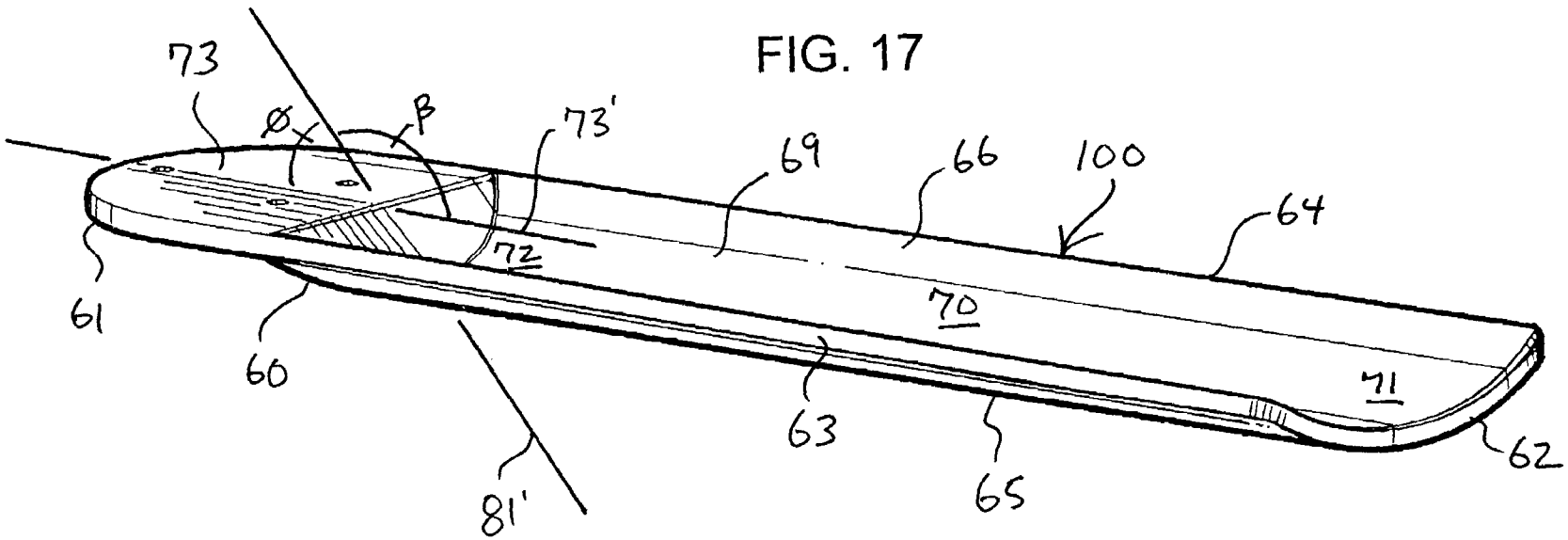
FIG. 17 is a bottom perspective view of an alternate embodiment of an impeller blade constructed and arranged in accordance with the principle of the invention.
Figure 19:
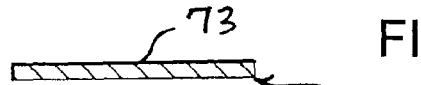
FIG. 19 is a sectional view taken along line 19-19 of FIG. 18.
Figure 18:
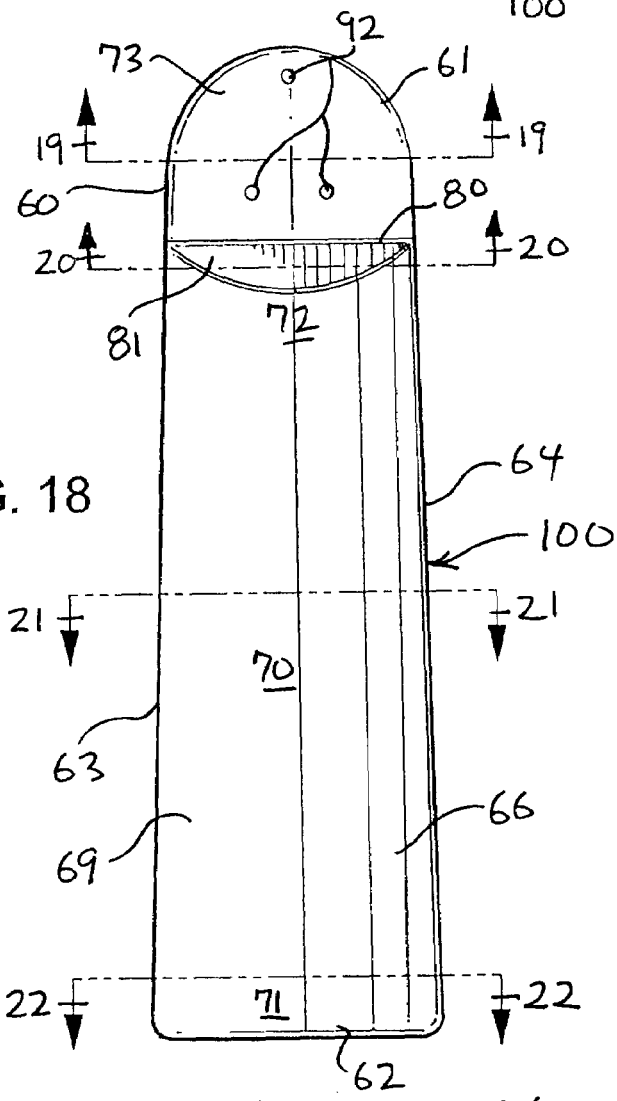
FIG. 18 is a bottom plan view of the impeller blade of FIG. 17.
Figure 20:
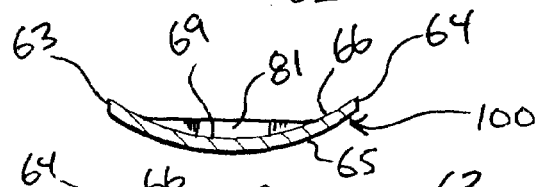
FIG. 20 is a sectional view taken along line 20-20 of FIG. 18.
Figure 21:
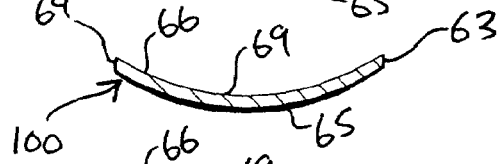
FIG. 21 is a sectional view taken along line 21-21 of FIG. 18.
Figure 22:
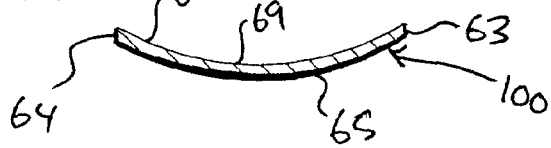
FIG. 22 is a sectional view taken along line 22-22 of FIG. 18.
Figure 23:
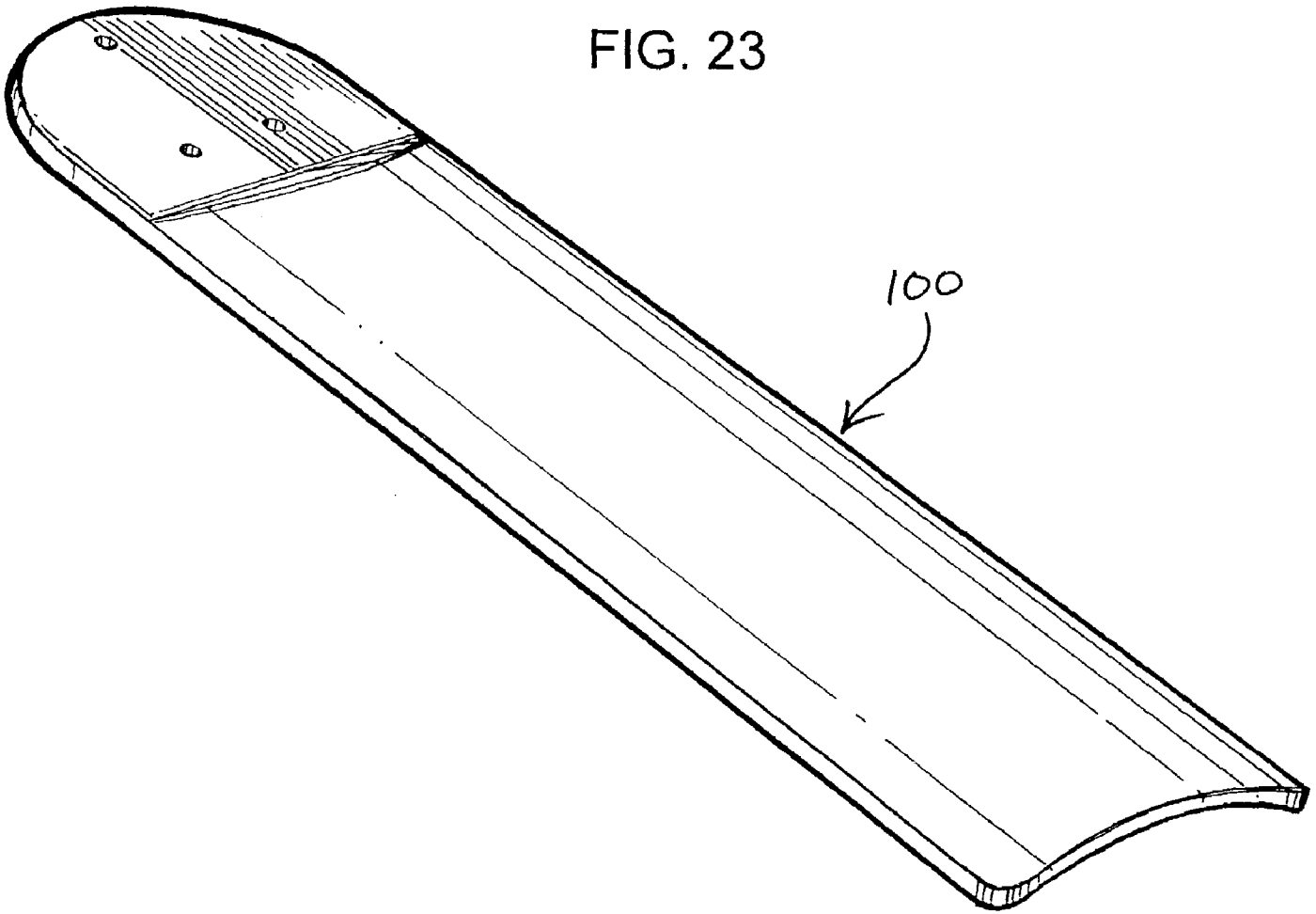
FIG. 23 is a top perspective view of the impeller blade of FIG. 17.
Figure 24:
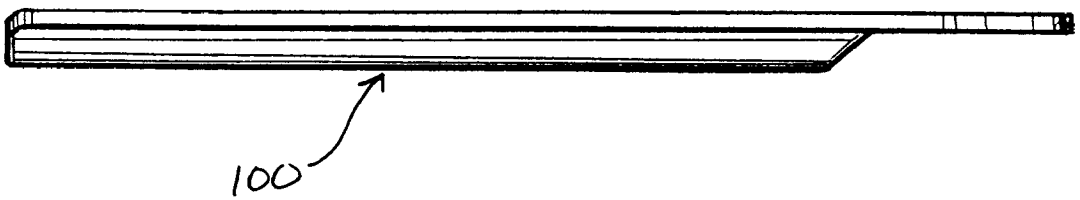
FIG. 24 is a left side elevational view of the impeller blade of FIG. 17.
Figure 25:
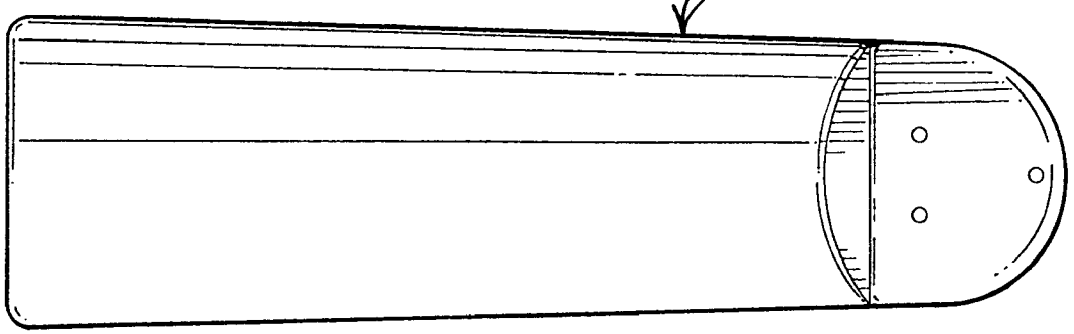
FIG. 25 is a top plan view of the impeller blade of FIG. 17.
Figure 29:
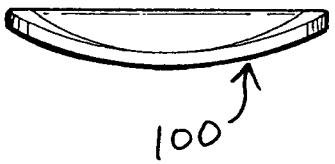
FIG. 29 is a front elevational view of the impeller blade of FIG. 17.
Figure 27:
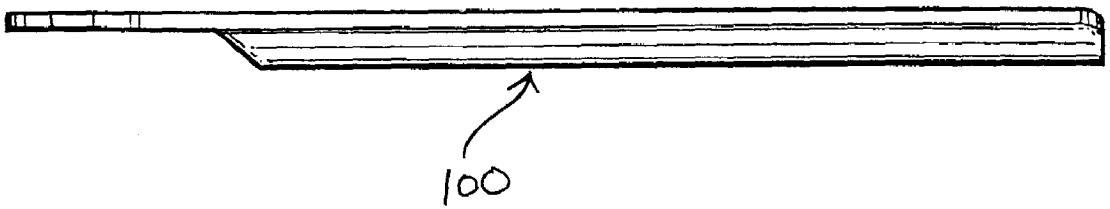
FIG. 27 is a right side elevational view of the impeller blade of FIG. 17.
Figure 28:
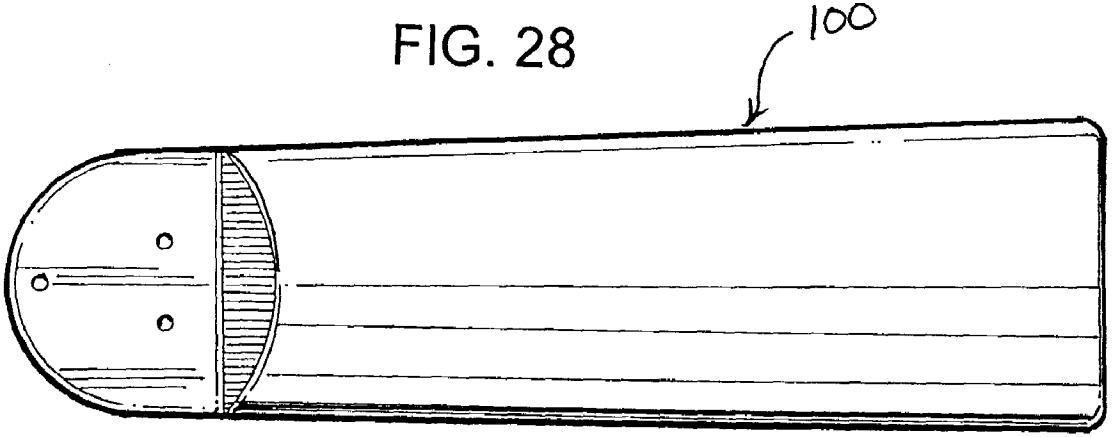
FIG. 28 is a bottom plan view of the impeller blade of FIG. 17.
Figure 26:
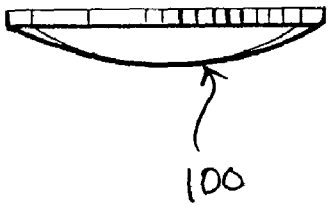
FIG. 26 is a rear elevational view of the impeller blade of FIG. 17.

FIGS. 17-29 show various views of impeller blade 100. As a matter of disclosure, FIG. 17 is a top perspective view of impeller blade 100, and FIG. 18 is a bottom plan view of impeller blade 100. The vertical sectional profiles of blade 100 are shown in FIGS. 19-22, in which FIG. 19 is a sectional view taken along line 19-19 of FIG. 18, FIG. 20 is a sectional view taken along line 20-20 of FIG. 18, FIG. 21 is a sectional view taken along line 21-21 of FIG. 18, and FIG. 22 is a sectional view taken along line 22-22 of FIG. 18. As see in FIG. 18 and also FIGS. 20-22, channel 70 widens gradually from closed end 72 to open end 71. Still further, FIG. 23 is a top perspective view of impeller blade 100, FIG. 24 is a left side elevational view of impeller blade 100, FIG. 25 is a top plan view of impeller blade 100, FIG. 26 is a rear elevational view of impeller blade 100, FIG. 27 is a right side elevational view of impeller blade 100, FIG. 28 is an unobstructed bottom plan view of impeller blade 100, and FIG. 29 is a front elevational view of impeller blade 100.

Figure 30:
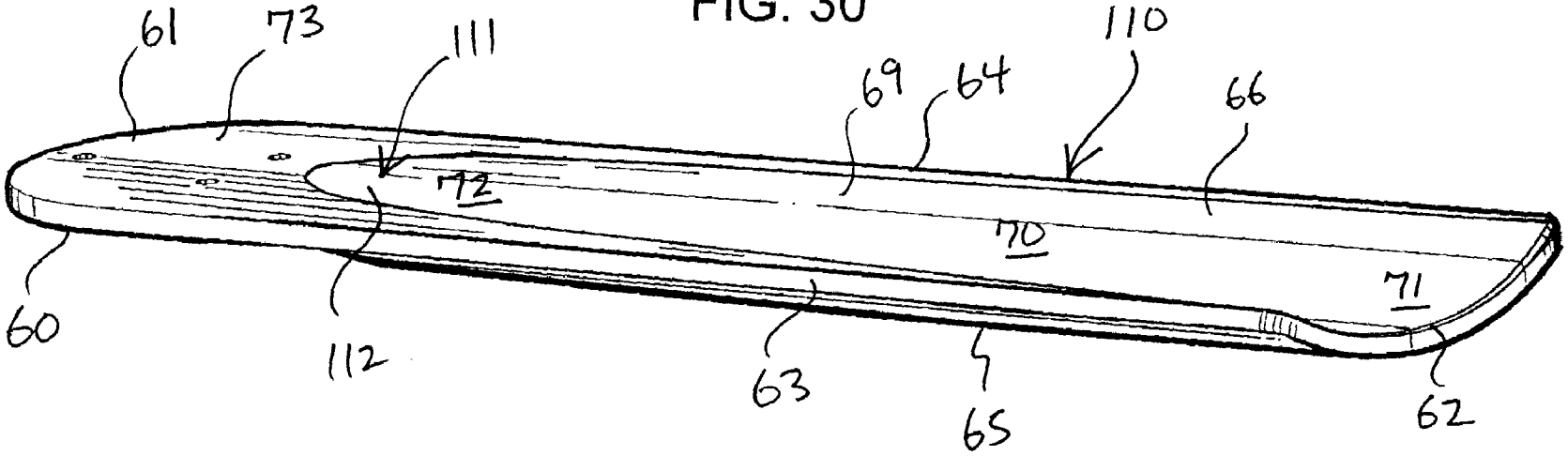
FIG. 30 is a bottom perspective view of yet another alternate embodiment of an impeller blade constructed and arranged in accordance with the principle of the invention.
Figures 34, 35, 36, 37, 38, 39:
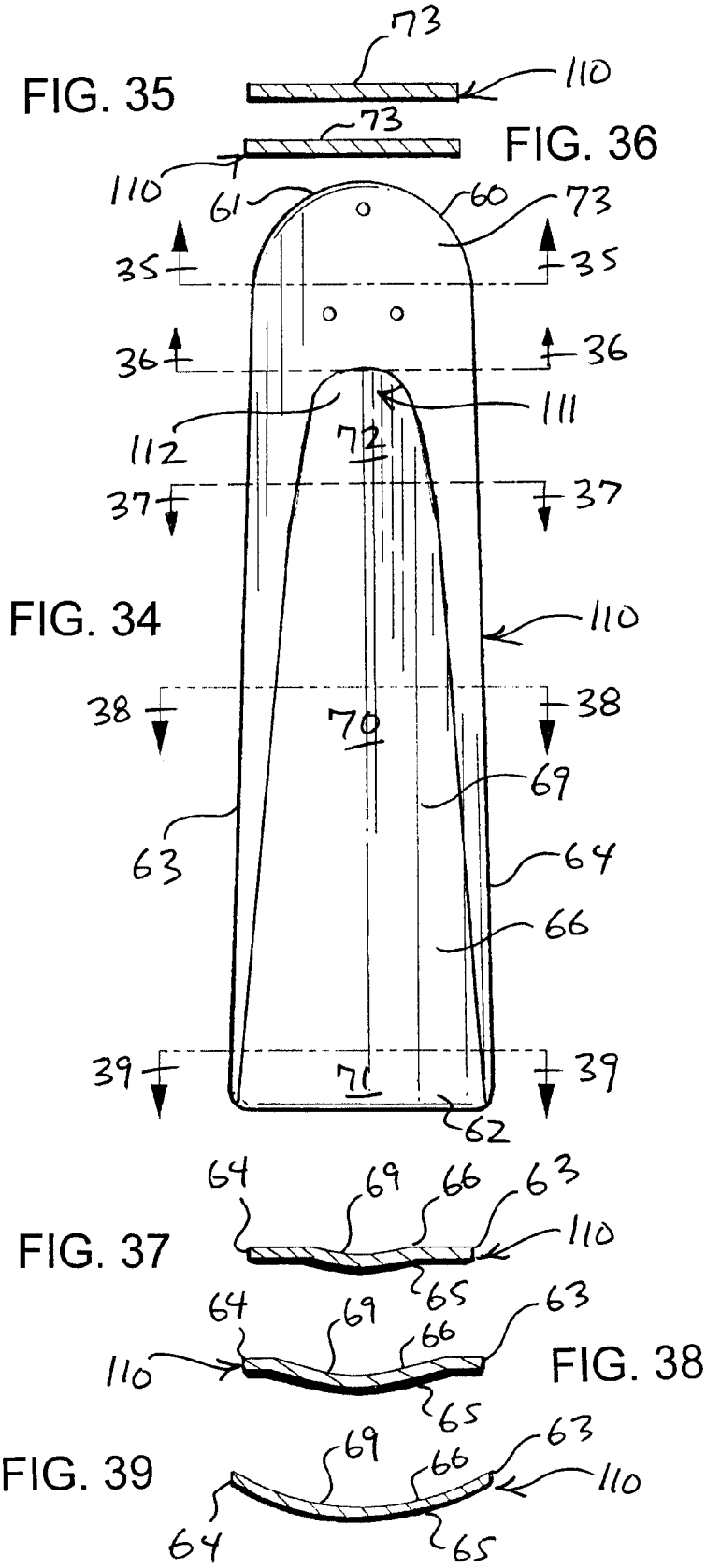
FIG. 34 is a bottom plan view of the impeller blade of FIG. 30.
FIG. 35 is a sectional view taken along line 35-35 of FIG. 34.
FIG. 36 is a sectional view taken along line 36-36 of FIG. 34.
FIG. 37 is a sectional view taken along line 37-37 of FIG. 34.
FIG. 38 is a sectional view taken along line 38-38 of FIG. 34.
FIG. 39 is a sectional view taken along line 39-39 of FIG. 18.

Turning now to FIG. 30-39 there is seen an alternate embodiment of an impeller blade 110 constructed and arranged in accordance with the principle of the invention. In common with impeller blade 52 set forth in conjunction with FIGS. 1-16, impeller blade 110 shares impeller blade body 60, proximal and distal ends 61 and 62, opposing edges 63 and 64, opposing upper and lower sides 65 and 66, concave major surface 69, concave channel 70 including open end 71 and closed end 72, and impeller blade bracket receiving face/surface 73. In this specific embodiment, it is seen in FIG. 34 that channel 70 tapers proximally from distal end 61 of body toward proximal end 62 of body 60, in which closed end 72 is characterized by a shallow, tapered pocket 111 formed as best seen in FIG. 30 by a rounded, tapered end wall 112. The purpose of impeller blade embodiment designated at 110 is to show that end wall 112 may be formed as rounded and tapered, rather than by a sharp, planar end wall as is the case with impeller blades 50 and 100. Other than this one difference, the remaining structural and functional characteristics of impeller blade 110 are identical to that of impeller blade 52, and so the foregoing discussion of impeller blades 52 also applies to impeller blade 110.

Figure 32:
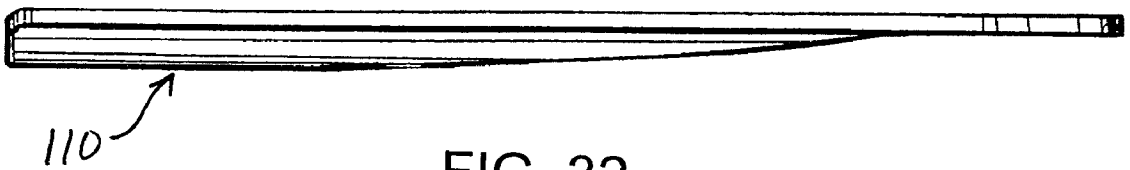
FIG. 32 is a left side elevational view of the impeller blade of FIG. 30.
Figure 31:
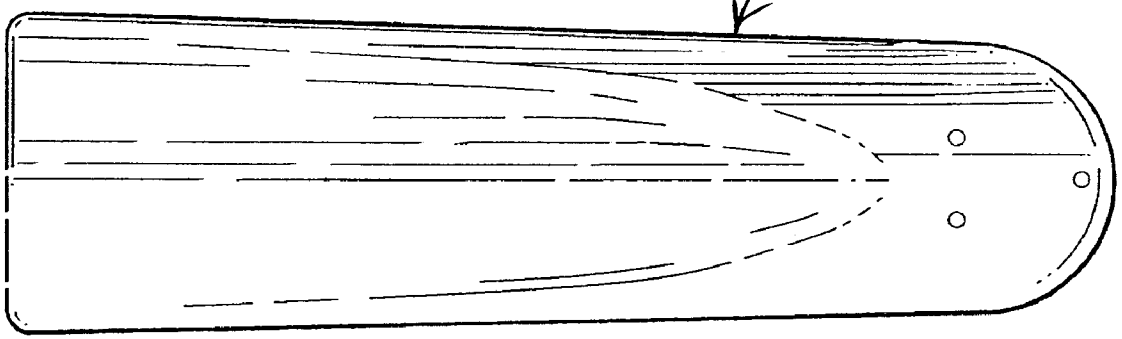
FIG. 31 is a top plan view of the impeller blade of FIG. 30.
Figure 33:
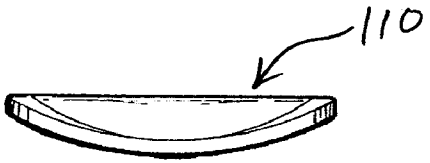
FIG. 33 is a front elevational view of the impeller blade of FIG. 30.

FIGS. 30-39 show various views of impeller blade 110. As a matter of disclosure, FIG. 30 is a bottom perspective view of impeller blade 110, FIG. 31 is a top plan view of impeller blade 110, FIG. 32 is a left side elevational view of impeller blade 110, FIG. 33 is a front elevational view of impeller blade 110, and FIG. 34 is a bottom plan view of impeller blade 110. The vertical sectional profiles of blade 110 are shown in FIGS. 35-39, in which FIG. 35 is a sectional view taken along line 35-35 of FIG. 34, FIG. 36 is a sectional view taken along line 36-36 of FIG. 34, FIG. 37 is a sectional view taken along line 37-37 of FIG. 34, FIG. 38 is a sectional view taken along line 38-38 of FIG. 34, and FIG. 39 is a sectional view taken along line 39-39 of FIG. 34. As see in FIG. 34 and also FIGS. 37-39, channel 70 widens gradually from closed end 72 to open end 71, and is tapers proximally toward proximal end 61 at pocket 111.

The invention has been described above with reference to preferred embodiments. However, those skilled in the art will recognize that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. An impeller blade, comprising:

an elongate impeller blade body including opposing proximal and distal ends, opposing first and second edges extending from the proximal end to the distal end, and opposing upper and lower sides;

the impeller blade body defines a longitudinal axis extending from the proximal end to the distal end;

the lower side including a major generally concave channel extending from an open end thereof at the distal end of the impeller blade body to a closed end thereof adjacent to the proximal end of the impeller blade body;

a bracket receiving face formed in the lower side between the closed end and the proximal end;

an end wall formed in the lower side of the impeller blade body at the closed end of the generally concave channel;

the end wall resides in an end wall plane;

the bracket receiving face resides in a receiving face plane;

the end wall plane is substantially perpendicular relative to the receiving face plane;

a generally concave surface formed in the lower side of the impeller blade body forms the generally concave channel that extends from the distal end of the impeller blade body to the end wall;

the bracket receiving face extends from the proximal end of the impeller blade body to a first edge of the end wall formed in the lower side of the impeller blade body and which is transverse relative to the longitudinal axis of the impeller blade body;

the end wall projects toward the generally concave surface from the first edge of the end wall terminating at the generally concave surface with a second edge of the end wall which is transverse relative to the longitudinal axis of the impeller blade body; and the end wall is transverse relative to the longitudinal axis of the impeller blade body and extends from the first edge of the impeller blade body to the second edge of the impeller blade body, the first edge of the end wall extends from the first edge of the impeller blade body to the second edge of the impeller blade body, and the second edge of the end wall extends from the first edge of the impeller blade body to the second edge of the impeller blade body and meets the first edge of the end wall at the first and second edges, respectively, of the impeller blade body to form the closed end in the lower side of the impeller blade body.

2. The impeller blade according to claim 1, wherein the bracket receiving face is generally planar.

3. The impeller blade according to claim 1, further comprising:

a hub mounted for rotation; and a bracket coupling the bracket receiving face to the hub.

* * * * *